US011236564B2

(12) United States Patent
Allamon et al.

(10) Patent No.: US 11,236,564 B2
(45) Date of Patent: Feb. 1, 2022

(54) HYBRID LINER HANGER AND SETTING TOOL

(71) Applicant: Allamon Properties LLC, Montgomery, TX (US)

(72) Inventors: Jerry P. Allamon, Montgomery, TX (US); Javier E. Bolivar, Montgomery, TX (US)

(73) Assignee: Allamon Tool Company, Inc., Montgomery, TX (US)

( * ) Notice: Subject to any disclaimer, the term of this patent is extended or adjusted under 35 U.S.C. 154(b) by 0 days.

(21) Appl. No.: 16/685,859

(22) Filed: Nov. 15, 2019

(65) Prior Publication Data

US 2020/0080395 A1 Mar. 12, 2020

Related U.S. Application Data

(63) Continuation of application No. 15/335,272, filed on Oct. 26, 2016, now Pat. No. 10,513,898.

(51) Int. Cl.

| | |
|---|---|
| ***E21B 23/01*** | (2006.01) |
| ***E21B 33/04*** | (2006.01) |
| ***E21B 43/10*** | (2006.01) |

(52) U.S. Cl.

CPC ..... *E21B 23/01* (2013.01); *E21B 33/04* (2013.01); *E21B 43/10* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,067,885 A | | 1/1937 | Brown | |
| 2,315,931 A | * | 4/1943 | Burt | E21B 33/14 166/122 |
| 3,223,170 A | * | 12/1965 | Mott | E21B 23/04 166/208 |
| 4,096,913 A | * | 6/1978 | Kenneday | E21B 23/006 166/120 |
| 4,262,702 A | | 4/1981 | Streich | |
| 4,311,195 A | | 1/1982 | Mullins | |
| 4,497,368 A | * | 2/1985 | Baugh | E21B 43/10 166/208 |
| 4,711,326 A | | 12/1987 | Baugh et al. | |
| 4,712,614 A | * | 12/1987 | Allwin | E21B 23/01 166/208 |

(Continued)

FOREIGN PATENT DOCUMENTS

| | | |
|---|---|---|
| WO | 9320329 | 10/1993 |

OTHER PUBLICATIONS

Extended European Search Report and Written Opinion for European Application No. 17865150.1 dated Apr. 30, 2020.

(Continued)

*Primary Examiner* — Cathleen R Hutchins
*Assistant Examiner* — Ronald R Runyan
(74) *Attorney, Agent, or Firm* — Tumey L.L.P.

(57) ABSTRACT

A setting mechanism for a liner hanger to be secured within the casing of an oil/gas well includes an expandable hydraulic chamber a portion of which is connected to a setting collar positioned around the liner hanger. Expansion of the chamber will cause the setting collar to radially move one or more slips having a gripping surface into contact with an inner surface of the casing.

2 Claims, 6 Drawing Sheets

(56) References Cited

U.S. PATENT DOCUMENTS

| | | | | |
|---|---|---|---|---|
| 4,712,615 | A | 12/1987 | Dockins et al. | |
| 5,318,131 | A | 6/1994 | Baker | |
| 6,739,398 | B1 * | 5/2004 | Yokley | E21B 23/01 166/123 |
| 7,886,831 | B2 * | 2/2011 | Butterfield, Jr. | E21B 43/105 166/177.4 |
| 10,513,898 | B2 * | 12/2019 | Allamon | E21B 33/04 |
| 2005/0006106 | A1 | 1/2005 | Hirth et al. | |
| 2010/0038096 | A1 | 2/2010 | Reimert et al. | |
| 2010/0170681 | A1 | 7/2010 | Purkis | |

OTHER PUBLICATIONS

International Search Report and Written Opinion for PCT/US2017/058321 dated Jan. 8, 2018.
International Preliminary Report on Patentability for Application No. PCT/US2017/058321, dated May 9, 2019.
USPTO Non-final Office Action for U.S. Appl. No. 15/335,272 dated Jul. 27, 2018.
USPTO Non-final Office Action for U.S. Appl. No. 15/335,272 dated Feb. 27, 2019.
USPTO Notice of Allowance for U.S. Appl. No. 15/335,272 dated Aug. 12, 2019.
USPTO Notice of Allowance for U.S. Appl. No. 15/335,272 dated Nov. 6, 2019.
USPTO Issue Notification for U.S. Appl. No. 15/335,272 dated Dec. 4, 2019.

* cited by examiner

HYBRID LINER HANGER AND SETTING TOOL

This application is a continuation of U.S. patent application Ser. No. 15/335,272 filed Oct. 26, 2016, the entire contents of which is hereby incorporated herein by reference thereto.

BACKGROUND OF THE INVENTION

1. Field of the Invention

This invention relates to a liner hanger and a setting tool for securing a liner hanger within an oil/ gas well.

2. Description of Related Art

Liner hangers are typically set in two different ways, mechanically and hydraulically. A mechanically set liner hanger is set by manipulating the work string while a hydraulic liner hanger is set by internal pressure. The major benefit of a mechanically set liner hanger is that they typically have pressure ratings that meet or exceed that that of the liner. The drawback is that they are difficult to set in a deviated hole and are not conducive to rotation. Hydraulically set liner hangers are better suited for rotation and setting in deviated wells. The problem with hydraulically set liner hangers is that they are limited to the pressure rating for the hydraulic cylinder on the liner hanger body. They are also prone to premature setting due to pressure spikes while circulating drilling fluids.

BRIEF SUMMARY OF THE INVENTION

The hybrid set liner hanger is a combination of these two methods. It moves the hydraulic setting mechanism away from the body of the liner hanger. This setting mechanism mechanically sets the liner hanger via a setting sleeve. This has several major benefits. The setting sleeve utilizes the space occupied by the cylinder/piston of a hydraulic set hanger. By doing this it increases the pressure rating over that of a hydraulic liner hanger and closer to that of a mechanical liner hanger. An anit-preset mechanism may also be employed in the setting tool that eliminates the possibility of prematurely setting before the desired depth.

BRIEF DESCRIPTION OF SEVERAL VIEWS OF THE DRAWINGS

For a detailed description of the preferred embodiments of the invention, reference will now be made to the accompanying drawings in which.

DETAILED DESCRIPTION OF THE INVENTION

Figure 1:
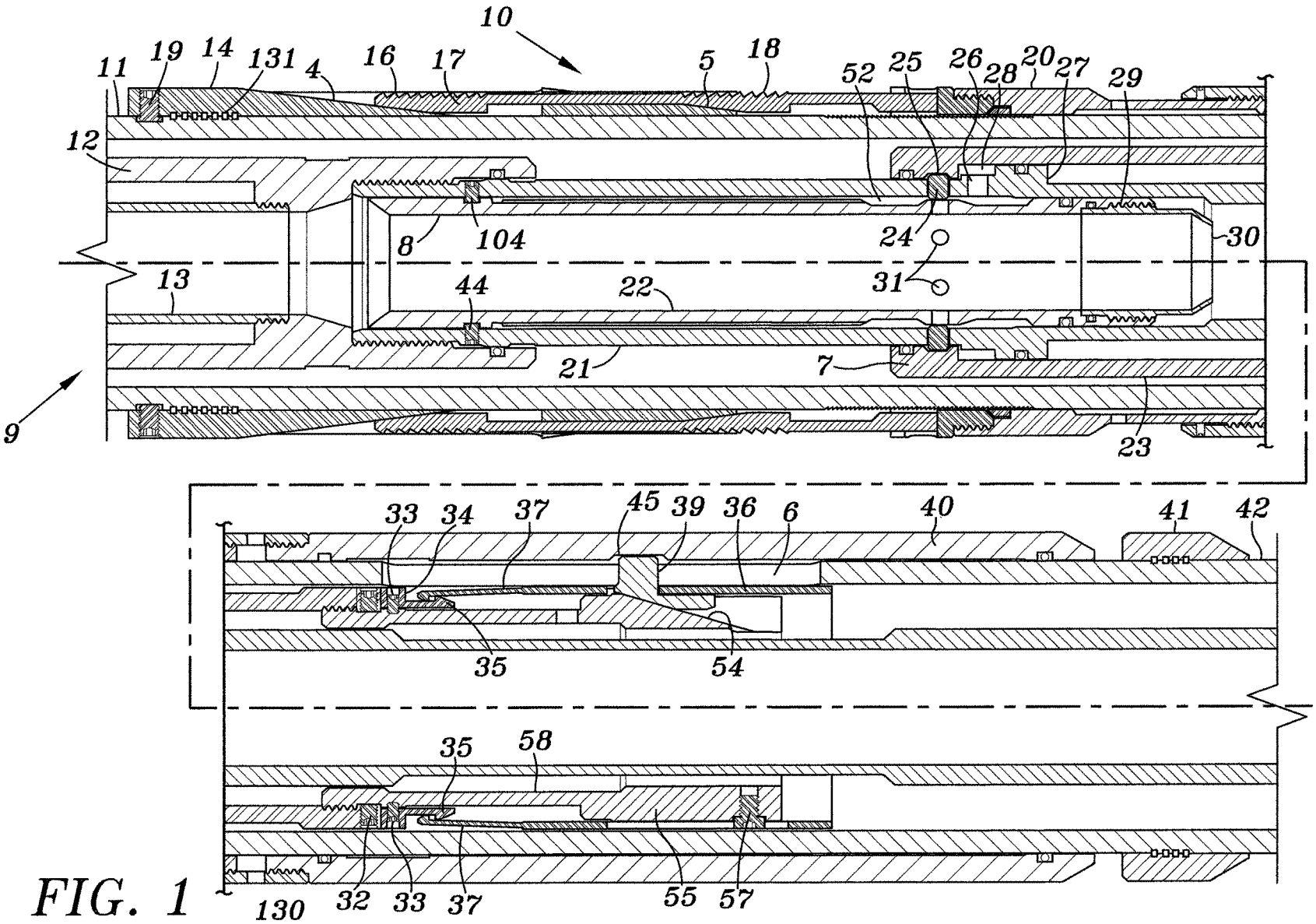
FIG. 1 is a cross-sectional view of an embodiment of the invention ready to be run into the well.

FIG. 1 illustrates an embodiment of the invention with a liner hanger 11, 42 and a running tool 9 which includes the setting mechanism for the liner hanger. Running tool 9 includes an outer housing 12 and an inner tubular 13.

A mandrel 21 of the setting portion 10 of the running tool is connected to the housing 12 by a suitable connection for example threads at one or more sheer pins 44 extend through mandrel 21 and into a groove 104 provided on the outer periphery of a cylindrical inner flow sleeve 22.

Inner flow sleeve 22 is axially movable within mandrel 21 and includes a grooved 52 on its outer surface which is adapted to receive a plurality of freely mounted locking pins 24 which are initially positioned over a plurality of ports 31 provided through the wall of cylindrical inner sleeve 22. Locking pins 24 extend through radially spaced holes 132 in mandrel 21 and initially extend into a groove 25 shown in FIG. 3 located at an enlarged end portion 7 of an outer sleeve 23 which is axially movable along mandrel 21. This arrangement forms an outer anti-preset mechanism that prevents premature setting of the liner hanger. Mandrel 21 also includes a port 26 extending through its outer periphery and also includes an enlarged portion 27. Portions 7 and 27 form an expandable hydraulic chamber 28 having as its inlet port 26. A ball catching restriction 30 is connected to inner sleeve 22 at 29 by threads, for example. Outer sleeve 23 is connected to a locking dog slide 55 by a suitable connection for example threads 130. Set screws 32 prevent rotational movement of outer sleeve 23 with respect to locking dog slide 55. Locking dog slide 55 includes a plurality of inclined surfaces 54 that are adapted to guide locking dogs 39 in a manner to be discussed below. An annular ring member 34 having a plurality of fingers 35 is pinned to locking dog slide 55 by shear pins 33.

Figure 5:
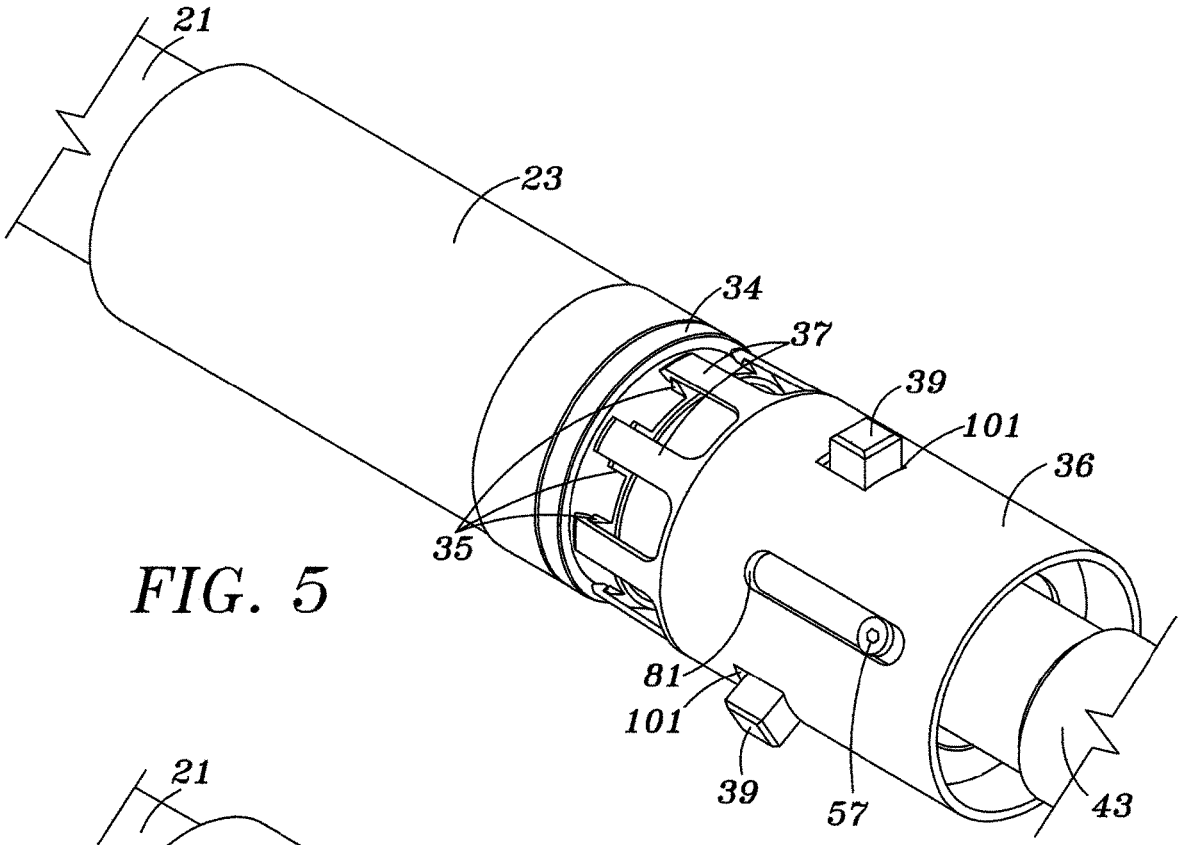
FIG. 5 is a perspective view of the release mechanism for the setting portion of the tool.
Figure 6:
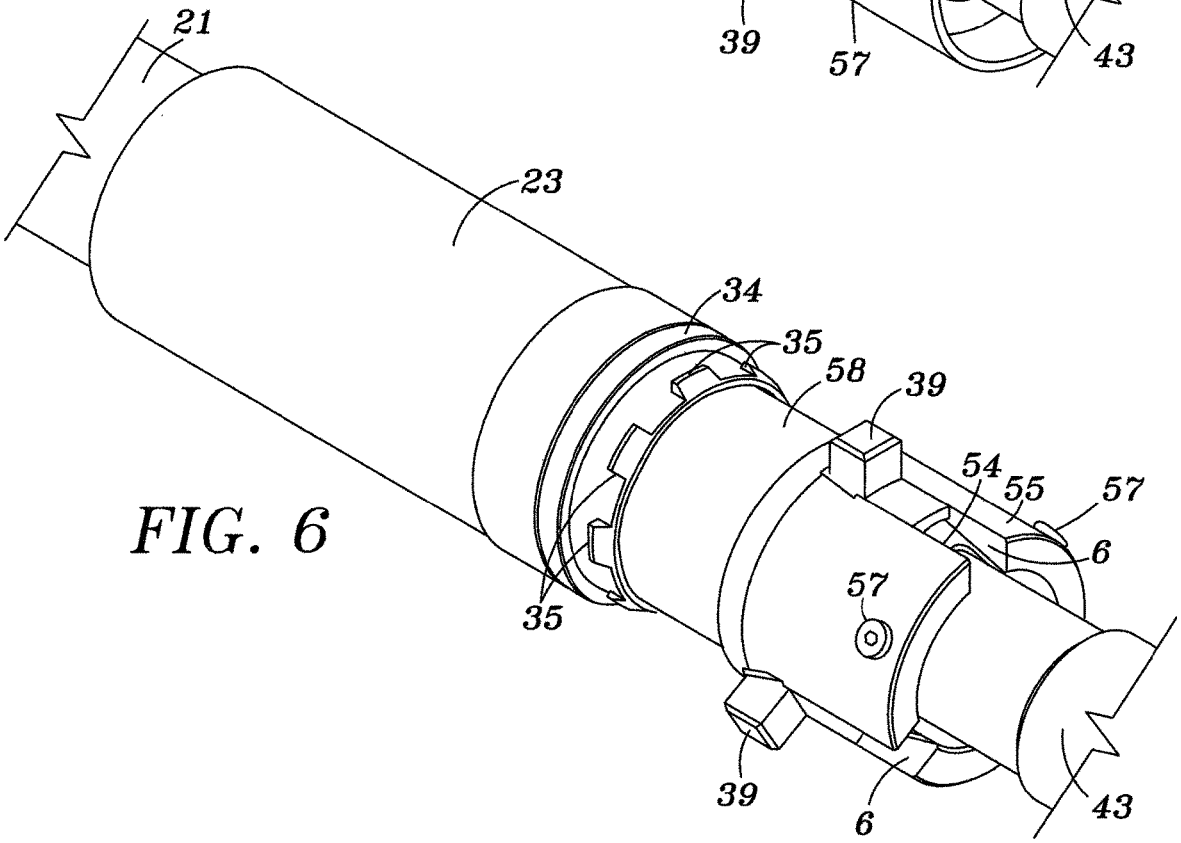
FIG. 6 is a perspective of the release mechanism shown in FIG. 5 with the locking dog slide removed.

An annular collar 36 having a plurality of fingers 37 surrounds locking dog slide 55 and has a plurality of openings 101 through which locking dogs 39 extend as best shown in FIGS. 5 and 6.

Annular collar 36 also includes a slot 81. A stop pin 57 extends through slot 81 and is secured to dog slide 55.

The liner hanger includes an uphole portion 11 and a downhole hole portion 42 to which a centralizer 41 may be attached. Liner hanger 11,42 includes a plurality of slots 6 through which locking dogs 39 initially extend into a grove 45 located on the inner surface of an axially movable setting collar 40 which surrounds liner hanger portion 42. Setting collar 40 is attached to an annular driving collar 20. A ramp 14 having one or more inclined surfaces 4 and 5 is secured to the liner hanger portion 11 by a plurality of locking pins 19.

Figure 7:
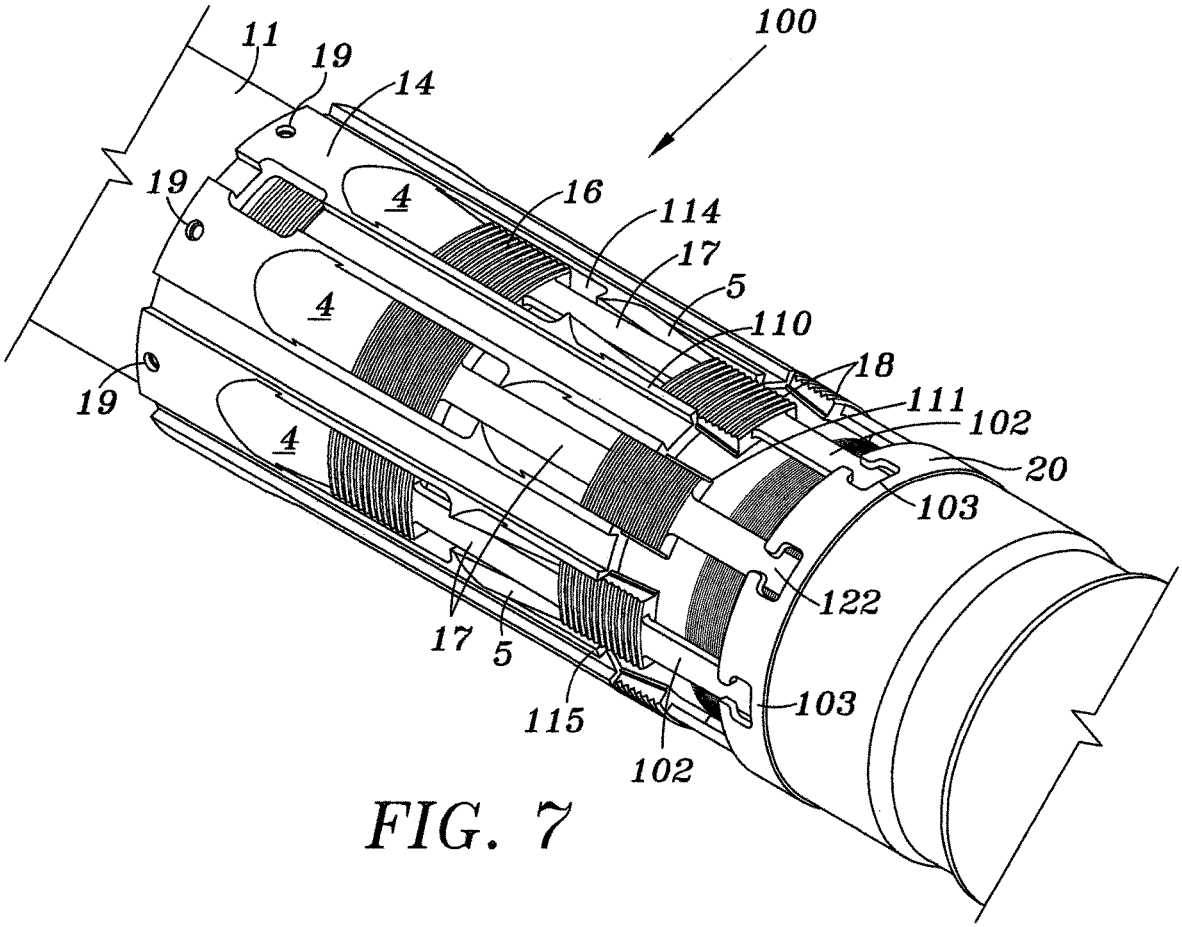
FIG. 7 is a perspective view of this slip assembly.

A plurality of slips 17 having gripping surfaces 16 and 18 are positioned radially around ramp 14 and engage driving collar 20 as shown in FIG. 7 so that axial movement of driving collar 20 in an uphole direction will cause slips 17 to move in a radial direction to come into contact with the inner surface of a well casing for example, not shown.

FIG. 7 is a perspective view of the slip assembly 100. It includes a ramp 14 having a first set of radially spaced ramps 4 and a second set of radially spaced ramps 5 that are axially spaced from the first set of ramps. A plurality of apertures 114 are located between the ramp sets. Ramp 14 is fixed to hanger liner 11 by a square wire 131. A plurality of set screws 19 or the like fix ramp 14 to hanger liner 11.

The assembly also includes driving annular collar 20 which slides on the liner hanger. Collar 20 has a plurality of T-shaped slots 103 that are adapted to receive the T-shaped ends 122 of slips elements 17. Slip elements 17 includes two spaced gripping surface 16 and 18.

Ramp 14 also includes a plurality of shoulders 110-115 that form longitudinally extending slots in which projections 111 of the slip elements are slideably retained.

Thus it can be seen that as annular collar 20 moves in an uphole direction or the left as shown in FIG. 7, slip elements 17 will be driven uphole with fixed ramps 4 and 5 causing gripping surfaces 16, 17 to radially expand into the interior surface of tubing not shown so as to set the liner hanger within tubing.

Figure 2:
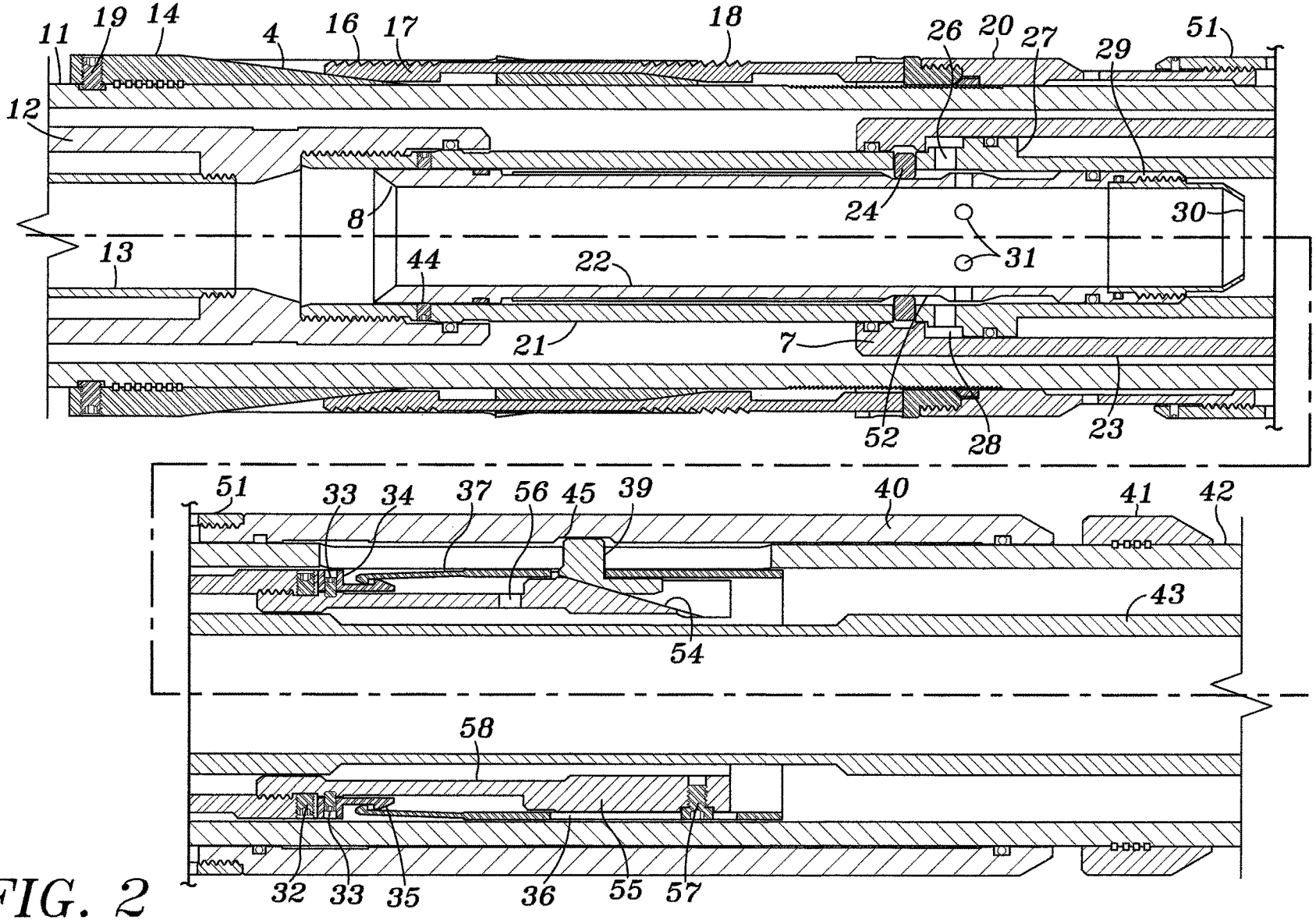
FIG. 2 is a cross-sectional view of the tool shown in FIG. 1 as pressure is initially applied to the tool.

Mode of Operation:

To set the liner casing in the well, a known running tool with a housing 12 and an inner tubular 13 is connected to the liner casing setting assembly 10 and run into the well at a desired location as shown in FIG. 1. A ball is dropped through tubular 13 and is caught by restriction 30. Fluid under pressure is introduced into inner sleeve 22. Fluid pressure will shear pins 44 which will allow inner sleeve 22 to move downhole. This movement will drop locking pins 24 into groove 52 thus allowing fluid under pressure to enter hydraulic chamber 28 via ports 31 and 26 as shown in FIG. 2.

Figure 3:
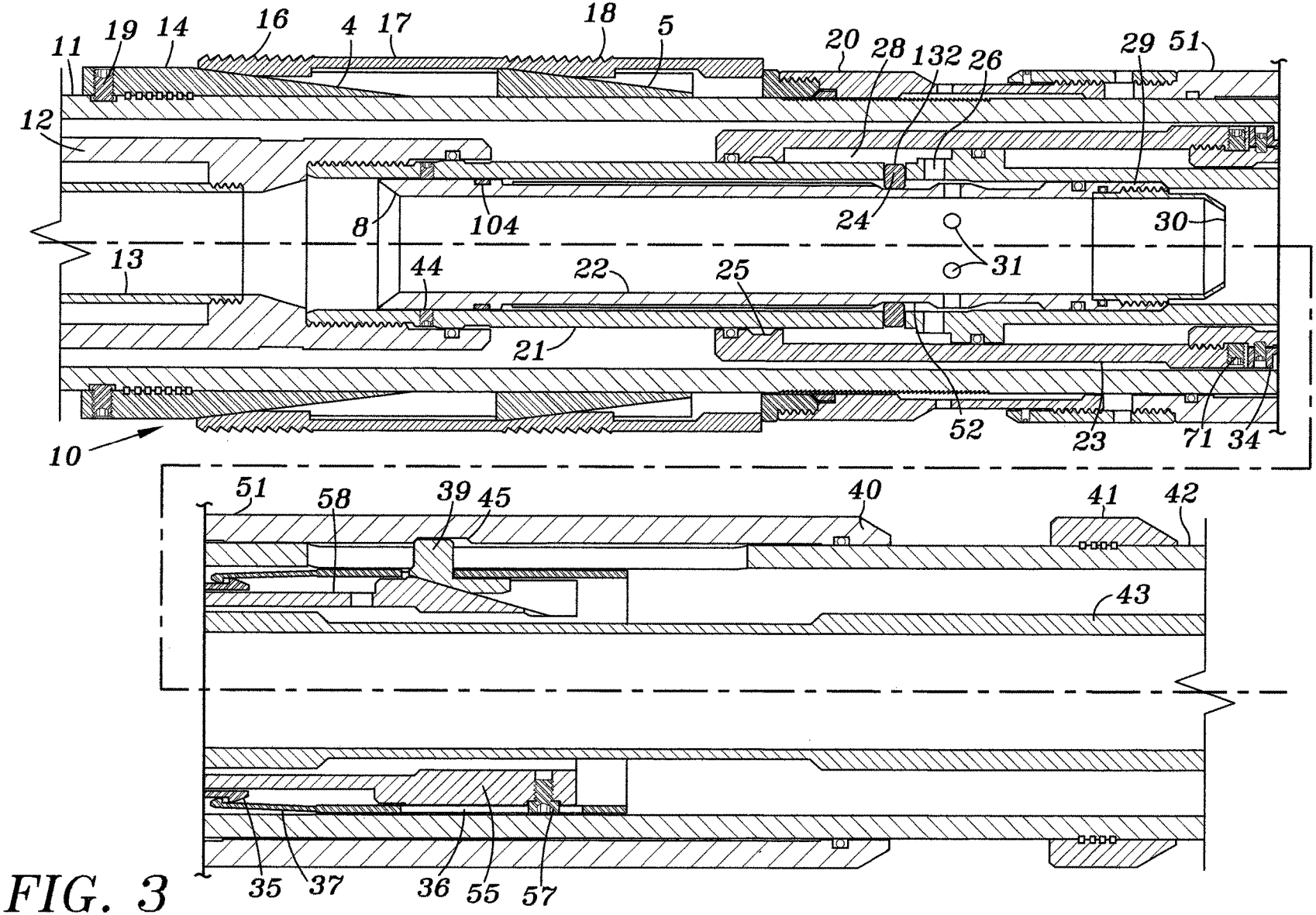
FIG. 3 is a cross-sectional view of the tool as shown in FIG. 1 as additional pressure is applied to the tool.

Pressure within hydraulic chamber 28 will cause outer sleeve 23 to move uphole as shown in FIG. 3. Outer sleeve 23 will carry with it collar 34, fingers 35, fingers 37 of annular collar 36, locking dog slide 55 and locking dogs 39 to position shown in FIG. 3. This is the primary setting mechanism.

This movement also drives annular setting collar 40 via dogs 39 in groove 45 which in turn drives driving collar 20 into slips 17 which causes slips 17 to expand radially outwardly by virtue of slopping surfaces 4 and 5. In this manner gripping surface 16 and 18 of the slips are driven into to surrounding casing of the well, not shown.

In order to withdraw the running tool from the liner hanger, a pulling force is applied to the running tool which shears pins 33. This allows locking dog slide 55 to be pulled to the position shown in FIG. 4 where locking dogs 39 slide rearwardly down ramps 54 thereby disengaging from groove 45 in annular setting collar 40. The running tool and setting assembly 10 may now be removed from the liner hanger which is set in place.

Figure 4:
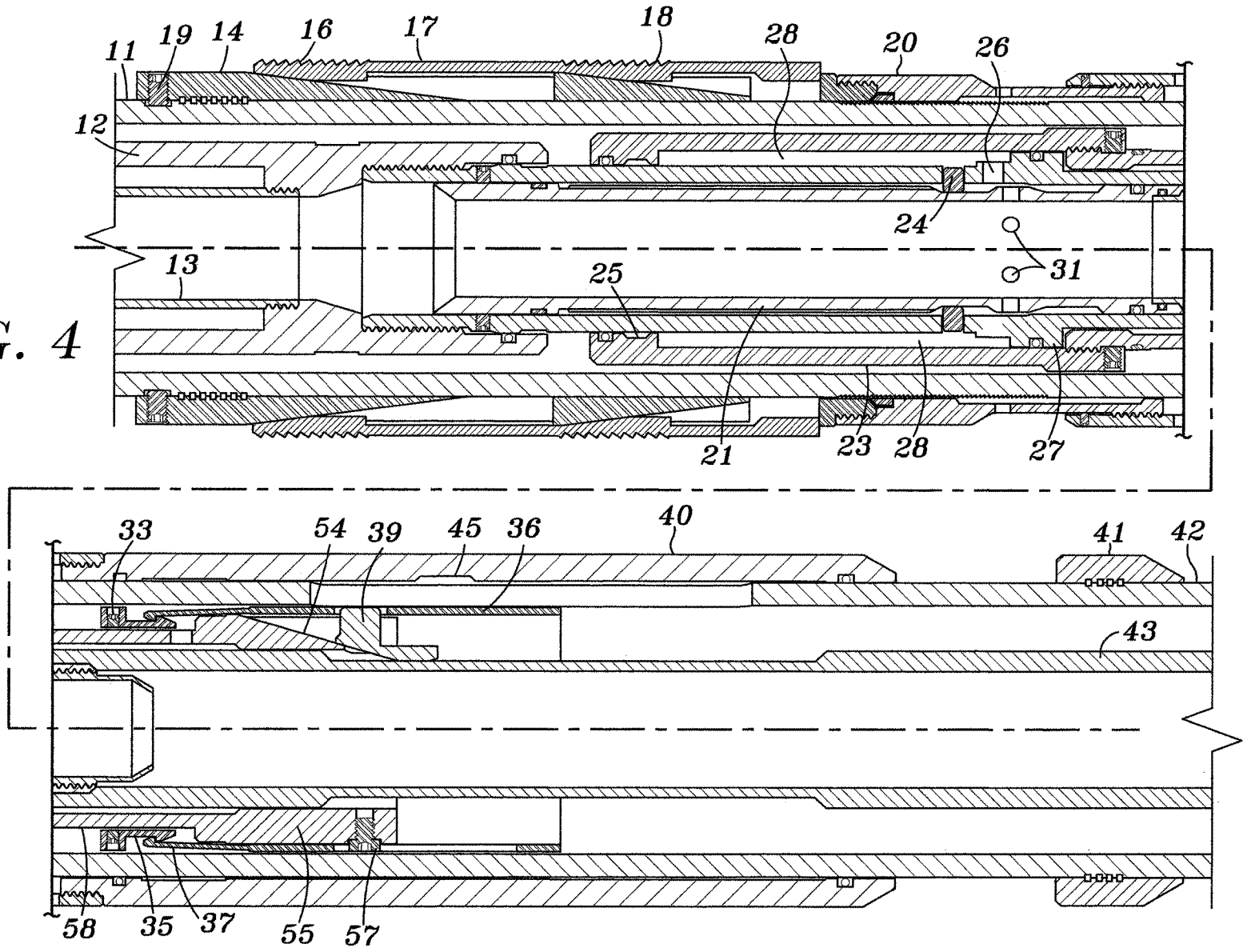
FIG. 4 is a cross-sectional view of the tool of FIG. 1 is a position allowing the setting portion of the tool to be withdrawn from the liner hanger.

According to another aspect of the invention, it is possible to set the liner hanger in the event that flow sleeve 22 cannot be moved, for example if a ball is not able to reach restriction 30. By pulling up on running tool 9, locking dogs 39 will move setting collar 40 in an uphole direction, thereby setting the liner hanger. Additional pulling of the running tool will cause shear pins 33 to shear which will allow locking dogs 39 to slide down ramps 54 as shown in FIG. 4. This will allow the setting mechanism to be withdrawn from the liner hanger.

Although the present invention and its advantages have been described in detail, it should be understood that various changes, substitutions and alterations may be made herein without departing from the spirit and scope of the invention as defined by the appended claims.

What is claimed is:

1. A liner hanger for an oil/gas well comprising:

a) a tubular member having at least one slot in a wall portion of the tubular, b) an annular setting collar slidably mounted on an exterior surface of the tubular, c) at least one slip member having an inclined surface, the at least one slip member adapted to be moved in a radial direction by the annular setting collar, d) at least one ramp secured to the tubular, wherein the at least one ramp is configured to physically reposition the at least one slip in a radial direction e) an annular groove on an interior surface of the annular setting collar, the groove adapted to receive one or more locking dogs of a setting mechanism.

2. A method of setting a liner hanger within a casing of an oil/gas well which includes a primary setting mechanism and a fail-safe setting mechanism comprising:

a) positioning the liner hanger comprising a tubular member having at least one slot in a wall portion of the tubular within the casing with the use of a running tool, wherein an annular groove on an interior surface of the annular setting collar is adapted to receive one or more locking dogs of the primary setting mechanism;

b) upon failure of the primary setting mechanism, pulling up on the running tool to actuate the failsafe setting mechanism which includes the one or more locking dogs and a setting collar and at least one slip which are part of the primary setting mechanism.

* * * * *